US011236771B2

(12) United States Patent
Huehn

(10) Patent No.: US 11,236,771 B2
(45) Date of Patent: Feb. 1, 2022

(54) ACTUATING PISTON AND ADJUSTMENT INSTALLATION

(71) Applicant: Robert Bosch GmbH, Stuttgart (DE)

(72) Inventor: Bernd Huehn, Elchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/026,431

(22) Filed: Sep. 21, 2020

(65) Prior Publication Data

US 2021/0102559 A1 Apr. 8, 2021

(30) Foreign Application Priority Data

Oct. 2, 2019 (DE) ..... 10 2019 215 159.0

(51) Int. Cl.
*F15B 15/14* (2006.01)

(52) U.S. Cl.
CPC ..... *F15B 15/1452* (2013.01); *F15B 15/1428* (2013.01)

(58) Field of Classification Search
CPC ..... F15B 15/1452; F15B 15/1428; F15B 15/1471
See application file for complete search history.

(56) References Cited

FOREIGN PATENT DOCUMENTS

| | | | | |
|---|---|---|---|---|
| DE | 10 2017 211 750 A1 | | 1/2019 | |
| DE | 102017211750 A1 | * | 1/2019 | ..... F04B 1/20 |
| DE | 10 2017 219 361 A1 | | 5/2019 | |

OTHER PUBLICATIONS

Bosch-Rexroth AG, "A4VG . . . ET5 / 32, Variable Pump Size 71," Data Sheet RDE 92003-84-P/03.2016, Mar. 2016, Elchingen, DE (German and English language document) (1 page).

* cited by examiner

*Primary Examiner* — Abiy Teka
(74) *Attorney, Agent, or Firm* — Maginot, Moore & Beck LLP

(57) ABSTRACT

An actuating piston for a hydrostatic adjustment installation includes at least one sealing and guiding unit which is insertable into a circumferential recess of an actuating piston. The circumferential recess is composed of two regions, and has the effect of improving the guiding and sealing of the actuating piston. The actuating piston is arranged in an adjustment installation.

14 Claims, 3 Drawing Sheets

ACTUATING PISTON AND ADJUSTMENT INSTALLATION

This application claims priority under 35 U.S.C. § 119 to application no. DE 10 2019 215 159.0, filed on Oct. 2, 2019 in Germany, the disclosure of which is incorporated herein by reference in its entirety.

The disclosure relates to an actuating piston for a hydrostatic adjustment installation and to an adjustment installation.

BACKGROUND

Actuating pistons which are received so as to be longitudinally displaceable in an actuating cylinder and thus configure a hydrostatic adjustment installation which can generate high actuating forces even in the case of small dimensions are known from the prior art. If actuating members which are pivotable by the actuating piston are eccentrically articulated, the actuating piston in terms of the latter being guided in the actuating cylinder is subject not only to an axial force but also to a radial force or transverse force that acts transversely to said axial force. Accordingly, the actuating piston must be guided in its cylinder in a reliable manner so as to be stable in terms of tilting. At the same time, there is the object of reliably sealing a pressurized actuating chamber which is delimited by the actuating piston in the actuating cylinder.

Multi-part solutions for a sealing and guiding installation which meets the above-mentioned requirements for a positive-displacement machine having an adjustable displacement volume are known in the prior art. For example, the Bosch-Rexroth data sheet RDE 92003-84-P/03.2016 thus shows an axial piston pump in a swash-plate construction mode having an adjustable displacement volume and an adjustment installation in which a dual-action actuating piston is disposed in an actuating cylinder. The sealing of the actuating piston and the guiding of the latter in the actuating cylinder in terms of functioning herein takes place separately by way of individual elements which are received in an internal shell face of the cylinder and in a sealing and guiding manner contact the external shell face of the piston. The sealing element herein is "pressure-active", that is to say that a lip which is deformable in a radially inward manner is pressed against the external shell face of the actuating piston by the actuating pressure prevalent in the pressurized actuating chamber. The guide element has a comparatively large axial extent such that the piston is imparted stability in terms of tilting. Alternatively, the sealing and guiding installation can also be disposed so as to be proximal to the piston or the rod, respectively. The respective elements are assembled so as to be disposed in suitable grooves which hold said respective elements in an axial manner. It is disadvantageous in a solution of this type that up to three elements per sealing and guiding installation have to be assembled, this meaning a high level of complexity in terms of material and assembly. Moreover, an assembly error is possible on account of the number of parts. Post-assembly calibration is necessary when sintered elements, in particular with a Teflon content, are used.

An actuating piston of the generic type for a hydrostatic adjustment installation is known from DE 10 2017 211 750 A1. The actuating piston has an external shell face that is encompassed by a sealing and guiding installation which is embodied as a sealing collar and by way of which the actuating piston is guided in an actuating cylinder so as to be stable in terms of tilting and displaceable in an axial manner, a gap between the actuating piston and the actuating cylinder being able to be sealed. The sealing and guiding unit is held on the actuating piston and is configured so as to be integral, therefore having a dual function, that is to say that the sealing and guiding unit guides the actuating piston in the actuating cylinder and seals the actuating piston in relation to the actuating cylinder.

The production of the above-mentioned sealing collar is described in DE 10 2017 219 361 A1. Accordingly, the sealing collar which configures a sealing and guiding unit is initially present as an annular disk and is then expanded by means of an expansion device, wherein the annular disk folds inward so as to assume a conical shape. The internal diameter of the sealing collar in further expansion stages is subsequently expanded until the desired internal diameter has been reached and the annular disk has been formed so as to assume the shape of a cone or a sleeve. The sealing collar is then applied to the actuating piston by means of a compression device, wherein the sealing collar is brought to the nominal diameter of the latter.

It is disadvantageous in the afore-described actuating pistons that the absorption of transverse forces on the actuating piston is restricted and the friction between the actuating piston and the actuating cylinder is increased.

SUMMARY

In contrast, the disclosure is based on the object of achieving an actuating piston in which the introduction of transverse forces is improved, and of achieving an adjustment installation having an actuating piston of this type.

The object is achieved by an actuating piston having the features described herein, or by an adjustment installation having the features set forth herein.

An actuating piston according to the disclosure for a hydrostatic adjustment installation, in particular for adjusting a displacement volume of a hydrostatic positive-displacement machine having a variable displaced volume, has an external shell face which is encompassed by a sealing and guiding unit. The sealing and guiding unit is disposed in a region of a circumferential recess of the external shell face of the actuating piston. The actuating piston by way of the sealing and guiding unit is able to be guided in an actuating cylinder of the hydrostatic adjustment installation so as to be stable in terms of tilting and displaceable in an axial manner. The sealing and guiding unit is conceived for sealing a gap between the external shell face of the actuating piston and an internal shell face of the actuating cylinder. According to the disclosure, the circumferential recess of the actuating piston is divided into two regions, wherein a first region is configured for absorbing transverse forces and a second region is configured for absorbing axial forces.

As opposed to the cited prior art, a base of the circumferential recess is configured such that protrusions are configured in the second region, while the first region is embodied in such a manner that the latter is optimized in terms of absorbing transverse forces. Moreover, particularly low-friction sealing and guiding is enabled on account of the subdivision into two regions. It is particularly advantageous that the hysteresis is substantially improved in comparison to the prior art.

The maximum diameter of the actuating piston incl. sealing/guiding is reduced in comparison to the prior art. The diameter of the high circumferential recesses of the second region is less; the compression tool can thus be smaller. After the calibration of the sealing/guiding element and after the relaxation of the sealing/guiding material a sealing diameter is created which is smaller in comparison to the prior art, this leading to substantially lower friction and thus to a reduced hysteresis.

The first region of the circumferential recess is preferably disposed on a side of the base of the circumferential recess that faces away from a pressurized chamber and is configured by a comparatively wide guide region for absorbing transverse forces, said guide region being radially elevated in relation to a base of the circumferential recess. On account of said guide region, the transverse force can be directed from the actuating piston into the housing bore by way of a large area. On account thereof, the load per area unit in the guide region is significantly reduced in comparison to solutions known from the prior art.

On account of the comparatively wide guide region in the first region, the radial deformation of the sealing and guiding unit under load and the wear during operation are significantly reduced in comparison to the known solutions from the prior art.

The radial dimension in the first region is preferably such that a centric gap of 0.01% to 0.25% of the actuating piston diameter is created after the sealing and guiding unit has been applied.

The second region is preferably disposed on the side of the circumferential recess that faces the pressurized chamber.

In one refinement of the disclosure, the axial extent of the guide region in the first region is larger by a multiple than the axial extent of the protrusions in the second region.

It has proven particularly advantageous for the sealing and guiding unit to be configured so as to be integral.

The protrusions in the second region are advantageously configured in a stepped manner. In other words, a first protrusion which is closest to the first region, when viewed in the radial direction of the actuating piston, is substantially smaller than a last protrusion which is closest to a pressurized-chamber-proximal end of the circumferential recess.

Proceeding from a separation region between the first and the second region, the diameter of the protrusions preferably increases toward the pressurized-chamber-proximal end of the circumferential recess.

The sealing and guiding unit at least in portions preferably engages directly in regions of the circumferential recess. The sealing and guiding unit engages in a form-fitting manner in at least one of the protrusions of the second region, in particular in all protrusions, and particularly preferably not in the guide region in the first region. The protrusions thus partially engage behind a circumferential face of the sealing and guiding unit, said circumferential face facing the external shell face of the actuating piston, in that said protrusions are pushed into the sealing and guiding unit and/or engage in recesses of the sealing and guiding unit, said recesses being disposed so as to be opposite the protrusions.

In one refinement the protrusions are configured in such a manner that said protrusions absorb axial forces acting on the sealing and guiding unit, thus guaranteeing sealing between the actuating piston and the actuating cylinder. End face portions of the protrusions engage in the sealing and guiding unit and thus absorb the forces, in particular axial forces, acting on the sealing and guiding unit, and dissipate said forces into the actuating piston.

It is particularly preferable herein for the protrusion having the largest radial extent, when viewed from the actuating piston, hereunder also referred to as the largest protrusion, to invade the sealing and guiding unit by at least more than 40%, preferably by 42%, of the initial thickness of said sealing and guiding unit in the freshly assembled state.

On account of such a shaping of the second region which substantially absorbs axial forces, in conjunction with the afore-described design embodiments of the first region which substantially absorbs transverse forces, a gap in the sealing region between the actuating piston and the actuating cylinder is avoided when interacting with the sealing and guiding unit, said gap potentially leading to leakages. By reducing the deformation under load, for example by virtue of the acting transverse force, and by reducing the wear, it is also prevented that the largest protrusion on the side facing the pressure invades the sealing and guiding unit by more than 55% of the material thickness of the latter and thus damages said sealing and guiding unit.

In one refinement the rebound of the sealing and guiding unit for material-related reasons is embodied in such a manner that a low-friction sealing diameter is configured after the sealing and guiding unit has been applied, which is also referred to as calibrating. In terms of low friction between the actuating piston and the actuating cylinder it is relevant that the maximum diameter of the actuating piston in conjunction with the sealing and guiding unit is only slightly larger than the bore diameter of the actuating cylinder. Sufficient tightness in association with lower friction is thus achieved. This sealing diameter is, for example, at most 0.5% larger than a bore diameter of the actuating cylinder. The sealing and guiding installation is conceived such that the sealing and guiding diameters are created when calibrating at room temperature.

A calibration sleeve can be used for applying the sealing and guiding unit to the actuating piston. Said calibration sleeve is at least 0.3% smaller than a bore diameter of the actuating cylinder. In order for the material-friendly calibrating of the sealing and guiding unit at room temperature to be enabled, a guide diameter is formed mainly by the dimensions of the diameter of the external circumferential recess in the first region and the material thickness, or the wall thickness, respectively, of the sealing and guiding unit and not by the compression when calibrating. The guide diameter thus bears on the first region and is less than the sealing diameter in the second region.

It is particularly preferable for the diameter of the actuating piston in end portions of the first and the second region of the circumferential recess to be in each case smaller than in the guide region of the first region. A space which extends between the sealing and guiding unit and the actuating piston is thus configured between the sealing and guiding unit and the base of the circumferential recess. The internal stress in the material of the sealing and guiding unit draws the latter into the space thus created and on the ends of the sealing and guiding unit, i.e. the end portions that face the pressurized chamber and face away therefrom, forms in each case a chamfer, the latter causing the configuration of a lubricating wedge in the case of a moving actuating piston, this further reducing the friction between the actuating piston and the actuating cylinder.

BRIEF DESCRIPTION OF THE DRAWINGS

The disclosure will be explained in more detail hereunder by means of an exemplary embodiment of an adjustment installation having an actuating piston.

In the figures.

DETAILED DESCRIPTION

Figure 1:
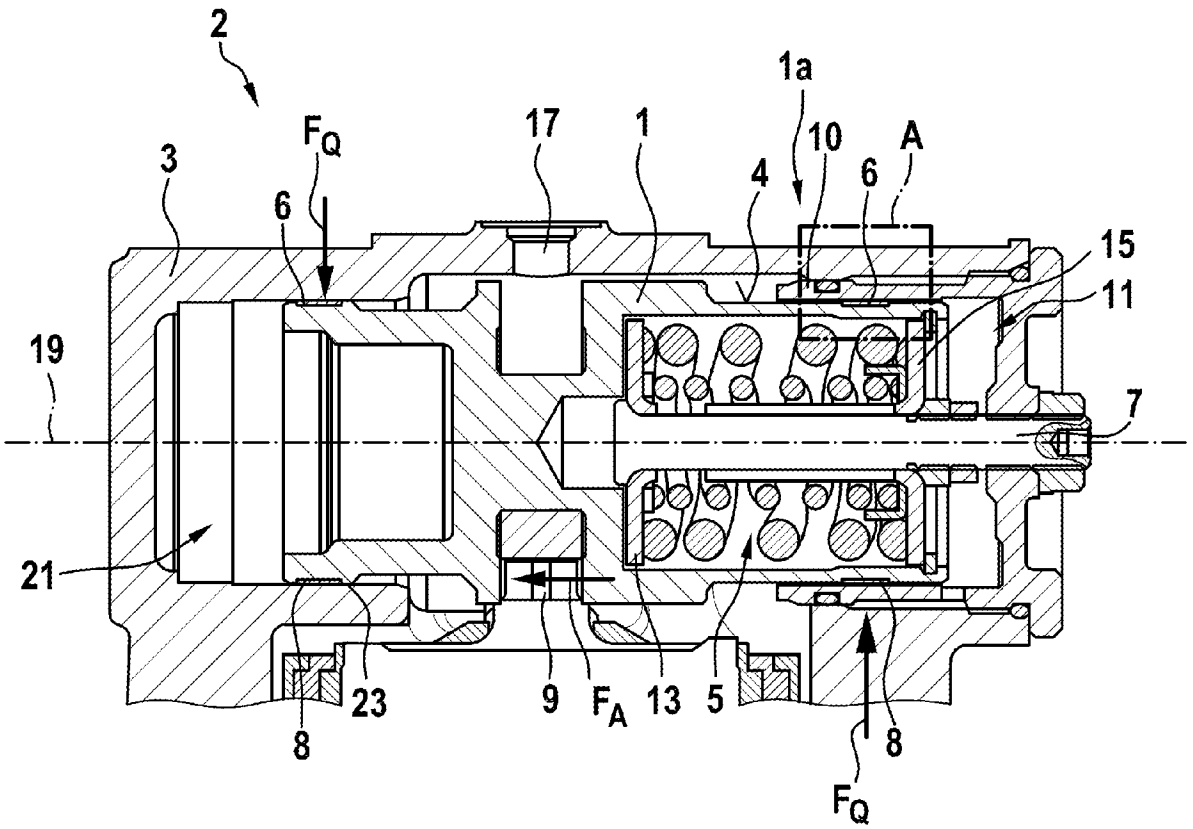
FIG. 1 shows a section through an adjustment installation.

FIG. 1 shows an actuating cylinder 1*a* having an actuating piston 1 of a hydrostatic adjustment installation 2 which is illustrated in portions. The actuating piston 1 has two encircling external shell faces 4 which in a shoulder region of the actuating piston 1 have in each case one sealing and guiding unit 6 which is disposed on or in, respectively, a respective circumferential recess 8 of the actuating piston 1. The sealing and guiding unit 6 is embodied as a sealing collar and is preferably produced from an annular disk according to the method disclosed in DE 10 2017 219 361 A1 mentioned at the outset. Said annular disk is preferably formed from a fluoroplastics material, in particular from PTFE. This material has good sliding and sealing properties. In terms of further details of the production method, reference is made to the above-mentioned publication.

The actuating piston 1 is guided so as to be displaceable along a longitudinal axis 19 in a main portion 3 of an actuating cylinder 1*a* configured with two functions, said actuating cylinder 1*a* being configured so as to be integral to a housing of the positive-displacement machine to be adjusted, or configured so as to be attachable to said housing. An end-side closure of the actuating cylinder 1*a* is formed by a cover 10.

A spring pack 5 is disposed in a spring chamber of the actuating piston 1 on a side of the actuating piston 1 (shown on the right in FIG. 1), said spring chamber in terms of the pressurizing medium being fluidically connected to a first pressurized chamber 11 of the actuating cylinder 1*a*. The pressurized chamber 11 is able to be impinged with an actuating pressure in order for the pivot angle to be adjusted. A pin 7 fixed on the housing is guided along the longitudinal axis 19 through the base of the cover 10 of the actuating cylinder 1*a* and is fastened to said base. A bush-shaped portion of the cover 10 in the axial direction extends into the main portion 3 such that the actuating piston 1 plunges partially into the cover 10 and one of the two sealing and guiding units 6 guides the actuating piston 1 along an internal shell face of the bush-shaped portion of the cover 10.

The pressurized chamber 11 penetrated by the pin 7 is partially delimited by the cover 10 and, as mentioned above, in terms of the pressurizing medium is fluidically connected to the spring chamber of the actuating piston 1 in which the spring pack 5 is received, said pressurized chamber 11 herein being sealed in relation to a zone that is not impinged with pressure. The sealing and guiding unit 6 (on the right in FIG. 1) is disposed in the gap between the actuating piston 1 and the cover 10. As mentioned above, a sealing and guiding unit 6 which is assigned to a second pressurized chamber 21 and has the same construction as the sealing collar described above is also provided on that side of the actuating piston 1 (left in FIG. 1) that is remote from the pressurized chamber 11.

A support disk 13 and a support disk 15 are disposed so as to be displaceable on the pin 7 in the pressurized chamber 11, said support disk 13 and support disk 15 delimiting the spring pack 5. When the pressurized chamber 11 is impinged with an actuating pressure, the actuating piston 1 is moved by an axial force $F_A$ (to the left according to the illustration in FIG. 1). The support disk 13 in this movement remains locationally fixed, while the support disk 15 is entrained by the actuating piston 1 counter to a spring force of the spring pack 5.

When the second pressurized chamber 21 is impinged with an actuating pressure, the actuating piston 1 by an axial force is moved to the right, counter to the $F_A$ illustrated in FIG. 1. The support disk 13 herein is moved by the actuating piston 1 counter to the spring force of the spring pack 5, and the support disk 15 remains locationally fixed on the pin 7 which is also referred to as an actuating rod. The positive-displacement unit can thus be adjusted in equal measure in both directions.

An adjustment pin 9 of the positive-displacement machine to be adjusted, as described in the prior art according to DE 10 2017 211 750 A1 mentioned at the outset, engages with a sliding block which on one side engages in a circumferential groove of the actuating piston 1. The adjustment pin 9 is displaced by the actuating piston 1 on account of an impingement with actuating pressure, this causing an adjustment of a displacement volume of a connected hydrostatic positive-displacement machine not shown here.

The spring force of the spring pack 5 acts counter to the axial force acting during an adjustment, for example the axial force $F_A$, and in the absence of an actuating pressure returns the actuating piston 1 to the central position thereof (illustrated in FIG. 1).

Transverse forces $F_Q$ arise on the actuating piston 1 on account of the one-sided eccentric position of the adjustment pin 9. The two sealing and guiding units 6 contribute toward the actuating piston 1 in the region of the main portion 3 and in the region of the cover 10 being guided in a stable manner in terms of tilting.

The two sealing and guiding units 6 which are in each case embodied as sealing collars have a minor wall thickness and are received in the shape of collars or sleeves in the circumferential recesses 8 of the external shell faces 4 of the actuating piston 1, said circumferential recesses 8 being adapted to said sealing and guiding units 6. A detailed description of the sealing and guiding units 6, the position, function and positioning of the latter, takes place by means of FIG. 2.

Figure 2:
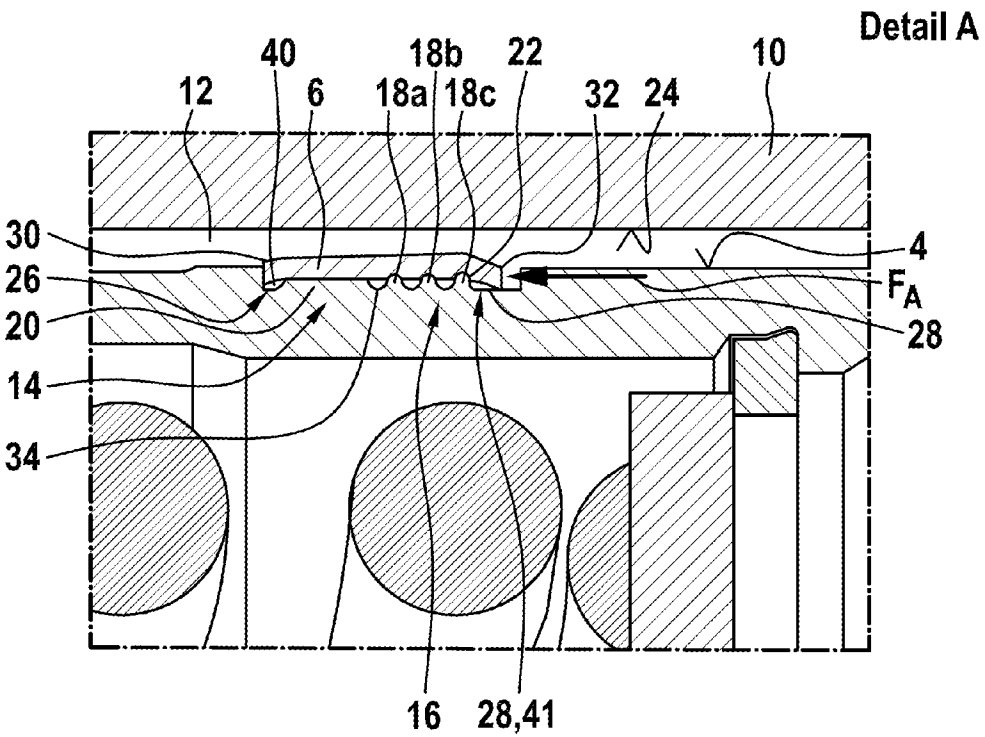
FIG. 2 shows a detailed illustration of an adjustment installation.

FIG. 2 shows the detail A as defined according to FIG. 1, wherein a fragment about the sealing and guiding unit 6 (on the right in FIG. 1) can be seen. The cover 10 and the main portion 3 of the actuating cylinder 1*a* configure an internal shell face 24 which encompasses the external shell face 4 of the actuating piston 1. A gap 12 is configured between the two shell faces 4, 24. According to FIG. 2, said gap is illustrated so as to be exaggerated for clarity. Not only the external side of the actuating piston 1 that delimits the gap 12 is referred to as the external shell face 4 at this juncture, but said external shell face 4 also comprises the circumferential recess 8 in which the sealing and guiding unit 6 is disposed.

As discussed above, the two sealing and guiding units 6 by expanding and compressing an annular disk are in each case configured in the manner of collars having a minor wall thickness, and are in each case disposed about/in the circumferential recess 8 of the actuating piston 1 (only the circumferential recess adjacent to the pressurized chamber 11 is provided with the reference sign 8 in FIG. 1). Said circumferential recess is in each case designed so as to correspond to the assigned sealing and guiding unit 6 in that said circumferential recess in the axial direction has a first region 14 and a second region 16 which are mutually spaced apart. The second region 16 has circumferential protrusions

18*a*, 18*b*, 18*c* which are mutually spaced apart in the axial direction and which hereunder are referred to as protrusions 18*a*, 18*b*, 18*c* and which, proceeding from a base 34 of the circumferential recess 8 extend in the radial direction. The number of protrusions 18*a*, 18*b*, 18*c* herein is not limited to the three protrusions 18*a*, 18*b*, 18*c* illustrated here. A smaller number as well as a larger number of protrusions is also conceivable.

The sealing and guiding unit 6 can have circumferential recesses which correspond to the protrusions 18*a*, 18*b*, 18*c* and which could receive the protrusions 18*a*, 18*b*, 18*c* in portions. The circumferential faces of the two sealing and guiding units 6 (sealing collars) are preferably planar (smooth), configured without recesses, wherein the protrusions 18*a*, 18*b*, 18*c* push into the circumferential wall such that radial plunging of the protrusions 18*a*, 18*b*, 18*c* into the sealing and guiding unit 6 results. A hybrid version having circumferential recesses in the sealing and guiding unit 6 is likewise conceivable, said circumferential recesses in terms of the radial extent thereof being smaller than the protrusions 18*a*, 18*b*, 18*c* such that plunging and pushing is combined. Independently of the type of the afore-described embodiment, the protrusions 18*a*, 18*b*, 18*c* are in engagement so as to engage axially behind the sealing and guiding unit 6.

The protrusions 18*a*, 18*b*, 18*c*, when viewed in the direction of an axial force $F_A$ resulting from the actuating pressure in the pressurized chamber 11, are of dissimilar sizes, wherein the first protrusion 18*c* which is disposed so as to be most remote from the first region 14 is larger than the second protrusion 18*b* which is larger than the smallest protrusion 18*a* which is disposed so as to be closest to the first region 14. The protrusions 18*a*, 18*b*, 18*c* are thus stepped, or disposed so as to decrease in size in the direction of the axial force $F_A$, respectively (see FIG. 2). The sealing and guiding unit 6 by way of end face portions 22 of the protrusions 18*a*, 18*b*, 18*c* is thus secured against displacement in the axial direction relative to the external shell face 4 of the actuating piston 1, only one end face portion of the largest protrusion 18*c* being provided with a reference sign in this illustration.

Figure 3:
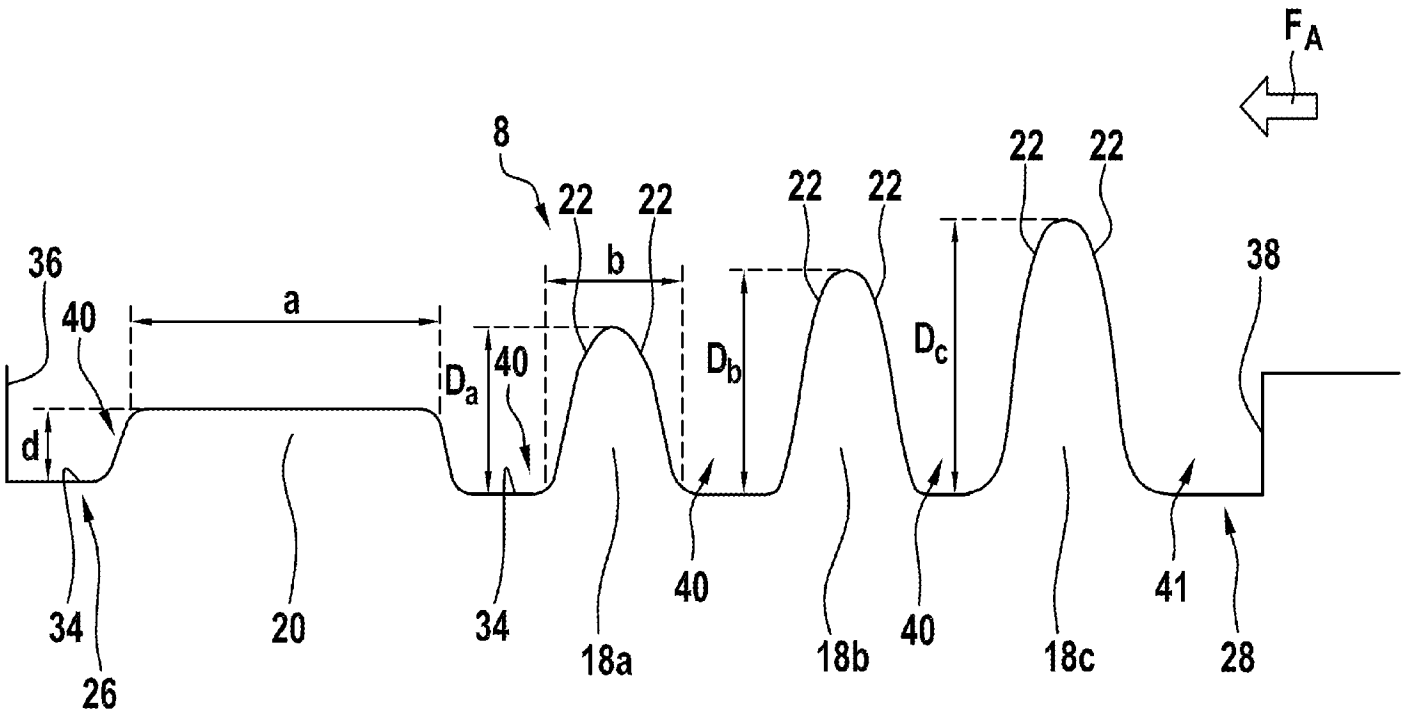
FIG. 3 shows a detailed illustration of a protrusion.

A detailed illustration of the circumferential recess 8 is shown in FIG. 3. The first region 14 of each circumferential recess 8 of the actuating piston 1 has a guide region 20 on which the sealing and guiding unit 6 bears. In contrast to the protrusions 18*a*, 18*b*, 18*c* in the second region 16, there is no engagement or any undercutting between the guide region 20 and the sealing and guiding unit 6. On account of the guide region 20 which is large in terms of area, transverse forces $F_Q$ which by way of the sealing and guiding unit 6 act on the actuating piston 1 can be substantially better absorbed and distributed than is the case in the solutions known from the prior art.

The guide region 20 has a radial extent d, hereunder also referred to as the height d, which is substantially less than the axial extent a, hereunder also referred to as the length a. A space 40 which is delimited by an end face 36 of the circumferential recess 8, on the one hand, and is delimited by the guide region 20 and circumferentially by the base 34, on the other hand, is configured in the region of the end portion 26. A corresponding space 41 is configured in a further end portion 28, said space 41 being delimited by an end face 38, on the one hand, and delimited by the protrusion 18*c* and circumferentially by the base 34, on the other hand. The protrusions 18*a*, 18*b*, 18*c* as well as the guide region 20 extend from the base 34 in the radial direction.

The radial extent $D_a$ of the smallest protrusion 18*a* is larger than the radial extent d of the contact area formed by the guide region 20 and larger than the axial extent b of the protrusions 18*a*, 18*b*, 18*c*. The radial extent $D_c$ is larger than the radial extent $D_b$ and the latter is larger than the radial extent $D_a$. The end face portions 22 which are configured on the protrusions 18*a*, 18*b*, 18*c* engage axially behind portions of the sealing and guiding unit 6 not illustrated here. These end face portions 22 absorb the axial force $F_A$ acting on the sealing and guiding unit 6 and by way of the protrusions 18*a*, 18*b*, 18*c* direct said axial force $F_A$ into the circumferential recess 8 and thus into the actuating piston 1.

The spaces 40, 41 in conjunction with the assigned sealing and guiding unit 6 configure radial gaps. Spaces are also configured between the guide region 20 and the protrusions 18*a*, 18*b*, 18*c*, as well as between the protrusions 18*a*, 18*b*, 18*c*. According to FIG. 2, the sealing and guiding unit 6 correspondingly does not bear on the base 34 of the circumferential recess 8. The internal stresses in the material of the sealing and guiding unit 6 draw the sealing and guiding unit 6 into the spaces 40, 41 configured in the region of the end portions 24, 26. The sealing and guiding unit 6 in the region of the end portions 24, 26 then configures in each case one chamfer 30, 32, said chamfers 30, 32 facilitating the configuration of a lubricating wedge in the case of the moving actuating piston 1. Moreover, a radial deformation of the sealing and guiding unit 6 which has effects which improve the sealing is moreover caused on account of the impingement of the sealing and guiding unit 6 with the axial force $F_A$ resulting from the actuating pressure.

Disclosed is an actuating piston for a hydrostatic adjustment installation having at least one sealing and guiding unit which is inserted into a circumferential recess of an actuating piston, said circumferential recess being composed of two regions, and has the effect of improving the guiding and sealing of the actuating piston. Furthermore disclosed is an adjustment installation which is configured having an actuating piston of this type.

LIST OF REFERENCE SIGNS

1*a* Actuating cylinder
1 Actuating piston
2 Hydrostatic adjustment installation
3 Main portion of the actuating cylinder
4 External shell face
5 Spring pack
6 Sealing and guiding unit
7 Pin
8 Circumferential recess
9 Adjustment pin
10 Cover of the actuating cylinder
11 Pressurized chamber
12 Gap
13 Support disk
14 First region
15 Support disk
16 Second region
17 Ventilation bore
18 Protrusion
19 Longitudinal axis
20 Guide region
21 Further pressurized chamber
22 End face portion
24 Internal shell face
26 End portion
28 End portion

30 Chamfer
32 Chamfer
34 Base
36 End face
38 End face
40 Chamber
41 Chamber
$F_A$ Axial force
$F_Q$ Transverse force
a Length/axial extent of the guide region 20
b Length/axial extent of the protrusion
d Height/radial extent of the guide region 20
D Height/radial extent of the protrusion

The invention claimed is:

1. An actuating piston for a hydrostatic adjustment installation comprising:

an external shell face defining a circumferential recess; and a sealing and guiding unit encompassing the external shell face in a region of the circumferential recess, the sealing and guiding unit configured to guide the actuating piston in an actuating cylinder of the hydrostatic adjustment installation so as to be stable in terms of tilting and displaceable in an axial manner, and to seal a gap between the external shell face of the actuating piston and an internal shell face of the actuating cylinder, wherein the circumferential recess has a first region having a guide region for the sealing and guiding unit that is configured to absorb transverse forces, and a second region having protrusions, wherein the first region has a larger axial extent than the second region, and wherein the guide region protrudes from a bottom surface of the circumferential recess and has a height with respect to the bottom surface of the recess that is less than a height of the protrusions in the second region.

2. The actuating piston according to claim 1, wherein an axial extent of the guide region is larger by a multiple than an axial extent of the protrusions.

3. The actuating piston according to claim 1, wherein the sealing and guiding unit is configured so as to be integral.

4. The actuating piston according to claim 1, wherein the protrusions in the second region, when viewed in a direction of an axial force resulting from an actuating pressure, have a decreasing diameter.

5. The actuating piston according to claim 1, wherein the protrusions push at least partially into a circumference of the sealing and guiding unit so as to engage behind the sealing and guiding unit, and/or the protrusions plunge into recesses of the sealing and guiding unit.

6. The actuating piston according to claim 5, wherein the protrusions push into the sealing and guiding unit during the deformation under a transverse force and/or according to wear takes place by at least 40% of an initial thickness of the sealing and guiding unit in a region of a largest protrusion of the protrusions.

7. The actuating piston according to claim 6, wherein the protrusions push into the sealing and guiding unit during the deformation under the transverse force and/or according to wear by at most 55% of the initial thickness of the sealing and guiding unit in the region of the largest protrusion.

8. The actuating piston according to claim 7, wherein the protrusions push into the sealing and guiding unit during the deformation under the transverse force and/or according to wear by at least 42% and at most 50% of the initial thickness of the sealing and guiding unit in the region of the largest protrusion.

9. The actuating piston according to claim 1, wherein the protrusions have end face portions that absorb axial forces acting on the sealing and guiding unit, the protrusions configured to seal a gap between the external shell face of the actuating piston and the internal shell face of the actuating cylinder.

10. The actuating piston according to claim 1, wherein the sealing and guiding unit, upon being applied to the actuating piston, has a sealing diameter which is at most 0.5% larger than an internal diameter of the actuating cylinder.

11. The actuating piston according to claim 1, wherein a diameter in end portions of the circumferential recess is smaller than a diameter of a contact area of the guide region.

12. The actuating piston according to claim 11, wherein the sealing and guiding unit, by way of the end portions of the circumferential recess produces a gap, which is reduced because of internal stresses of the sealing and guiding unit, the sealing and guiding unit plunging at least partially into the gap such that a chamfer is provided on the sealing and guiding unit.

13. The actuating piston according to claim 1, wherein the actuating piston is configured for adjusting a displacement volume of a hydrostatic positive-displacement machine having a variable displaced volume.

14. An adjustment installation comprising:

an actuating cylinder; and an actuating piston comprising:

an external shell face defining a circumferential recess; and a sealing and guiding unit encompassing the external shell face in a region of the circumferential recess, the sealing and guiding unit configured to guide the actuating piston in the actuating cylinder so as to be stable in terms of tilting and displaceable in an axial manner, and to seal a gap between the external shell face of the actuating piston and an internal shell face of the actuating cylinder, wherein the circumferential recess has a first region having a guide region for the sealing and guiding unit that is configured to absorb transverse forces, and a second region having protrusions, wherein the first region has a larger axial extent than the second region, and wherein the guide region protrudes from a bottom surface of the circumferential recess and has a height with respect to the bottom surface of the recess that is less than a height of the protrusions in the second region.

* * * * *